US009216884B2

(12) United States Patent
Smiley

(10) Patent No.: US 9,216,884 B2
(45) Date of Patent: Dec. 22, 2015

(54) NARROW AISLE LOAD HANDLER AND MATERIAL HANDLING VEHICLE INCLUDING A NARROW AISLE LOAD HANDLER

(71) Applicant: Gregory W. Smiley, Greene, NY (US)

(72) Inventor: Gregory W. Smiley, Greene, NY (US)

(73) Assignee: THE RAYMOND CORPORATION, Greene, NY (US)

( * ) Notice: Subject to any disclaimer, the term of this patent is extended or adjusted under 35 U.S.C. 154(b) by 117 days.

(21) Appl. No.: 13/793,018

(22) Filed: Mar. 11, 2013

(65) Prior Publication Data

US 2014/0255140 A1 Sep. 11, 2014

(51) Int. Cl.
*B66F 9/12* (2006.01)
*B66F 9/10* (2006.01)

(52) U.S. Cl.
CPC ... *B66F 9/12* (2013.01); *B66F 9/10* (2013.01); *B66F 9/125* (2013.01)

(58) Field of Classification Search
CPC ..... B66F 9/10; B66F 9/145; B66F 9/125; B66F 9/12; B66F 9/149; B66F 9/14; B66F 9/165; B66F 9/142; B66F 9/143; B66F 9/144
USPC ..... 414/664, 668, 785; 187/237
See application file for complete search history.

(56) References Cited

U.S. PATENT DOCUMENTS

| | | | | | |
|---|---|---|---|---|---|
| 2,643,784 | A | * | 6/1953 | Turner et al. | 414/665 |
| 3,232,465 | A | * | 2/1966 | Romine et al. | 414/668 |
| 3,495,725 | A | * | 2/1970 | Daya et al. | 414/544 |
| 3,557,974 | A | * | 1/1971 | Ostrander | 414/274 |
| 3,696,954 | A | * | 10/1972 | Weisker et al. | 414/668 |
| 3,977,542 | A | * | 8/1976 | Stolzer | 414/331.11 |
| 4,016,987 | A | * | 4/1977 | Stolzer | 414/283 |

* cited by examiner

*Primary Examiner* — Saul Rodriguez
*Assistant Examiner* — Mark Hageman
(74) *Attorney, Agent, or Firm* — Quarles & Brady LLP

(57) ABSTRACT

A material handling vehicle includes a vehicle body with a vertically extendible mast fixed to the vehicle body. A fork support is fixed relative to the mast and has a first side and a second side. The first side faces away from the second side. A first fork is mounted to the fork support and is movable between a first fork stored position and a first fork working position. In the first fork working position, the first fork extends substantially perpendicularly from the first side of the fork support. A second fork is mounted to the fork support and is movable between a second fork stored position and a second fork working position. In the second fork working position, the second fork extends substantially perpendicularly from the second side of the fork support.

19 Claims, 6 Drawing Sheets

NARROW AISLE LOAD HANDLER AND MATERIAL HANDLING VEHICLE INCLUDING A NARROW AISLE LOAD HANDLER

CROSS-REFERENCE TO RELATED APPLICATIONS

Not applicable.

STATEMENT CONCERNING FEDERALLY SPONSORED RESEARCH OR DEVELOPMENT

Not applicable.

FIELD OF THE INVENTION

The present invention relates to the field of material handling vehicles, and more specifically to a narrow aisle load handler on a lift truck.

BACKGROUND OF THE INVENTION

Lift trucks are designed in a variety of configurations to perform a variety of tasks. In one application, these tasks include the operation of a vertically movable platform to lift and lower a load, such as materials on a pallet into storage locations in a rack system having narrow aisles. Lift trucks especially suited for this application, such as a Raymond Corporation 9000 Series Swing-Reach® Trucks available from The Raymond Corporation, Greene, N.Y., have load handlers that can extend forks sideways relative to the trucks, i.e. into storage locations laterally adjacent to the truck direction of travel. These load handlers are typically rotatable 180degrees about a vertical axis in order to access rack storage positions on opposite sides of the truck.

Although these rotatable load handlers perform the required tasks in an exemplary manner, the mechanisms providing the rotating feature are complex and difficult to automate. Simplified, less complex load handlers can be more reliable and simpler to automate. It would therefore be desirable to provide a simplified load handler that can access rack storage positions on opposite sides of an aisle without having to rotate the entire load handler.

SUMMARY OF THE INVENTION

The present invention provides a simplified load handler and material handling vehicle that is less complex. In one aspect of the invention, a material handling vehicle having a novel load handler is provided. The material handling vehicle includes a vehicle body with a vertically extendible mast fixed to the vehicle body. A fork support is fixed relative to the mast and has a first side and a second side. The first side faces away from the second side. A first fork is mounted to the fork support and is movable between a first fork stored position and a first fork working position. In the first fork working position, the first fork extends substantially perpendicularly from the first side of the fork support. A second fork is mounted to the fork support and is movable between a second fork stored position and a second fork working position. In the second fork working position, the second fork extends substantially perpendicularly from the second side of the fork support.

In some embodiments, the first fork moves from the first fork working position to the first fork stored position simultaneously with the second fork moving from the second fork stored position to the second fork working position. The first and second forks can be physically joined to accomplish simultaneous movement or electronically coupled to accomplish the simultaneous movement. In other embodiments, the first and second forks are pivotally coupled to the fork support or slidably fixed to the fork support.

The foregoing and other objects and advantages of the invention will appear in the detailed description which follows. In the description, reference is made to the accompanying drawings which illustrate a preferred embodiment.

DETAILED DESCRIPTION OF THE PREFERRED EMBODIMENT

Figure 1:
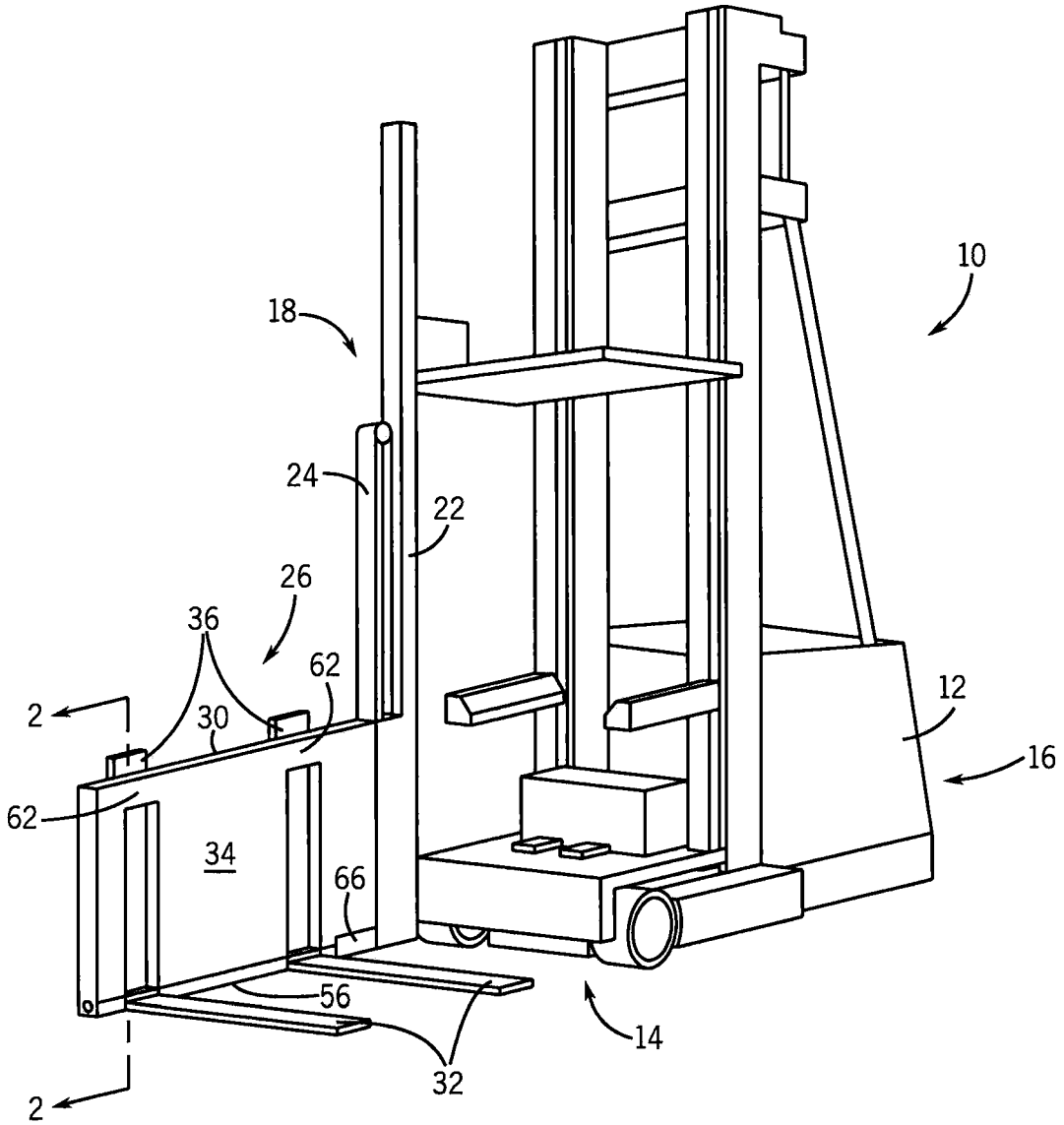
FIG. 1 is a perspective view of a lift truck having a load handler incorporating an embodiment of the invention.
Figure 2:
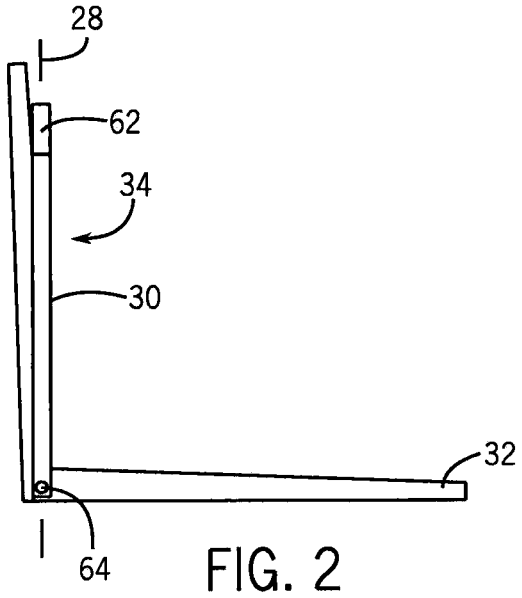
FIG. 2 is a sectional view along line 2-2 of FIG. 1.
Figure 3:
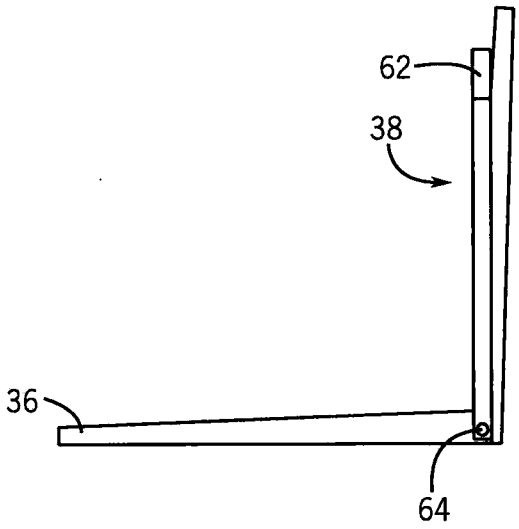
FIG. 3 is a sectional view of the load handler of FIG. 2 with the forks in different positions.

Referring now to the Figures, and more particularly to FIGS. 1 through 3, the general arrangement of a material handling vehicle or lift truck 10 in accordance with a preferred embodiment is shown. The lift truck 10 is substantially similar to a Raymond Corporation 9000 Series Swing-Reach® Trucks available from The Raymond Corporation, Greene, N.Y., and includes a tractor unit 12 having a front 14 and a rear 16. A vertically extendable mast 18 mounted to the front of the tractor unit 12 includes a fixed base 22 and an extendable mast section 24.

A novel vertically movable load handler 26 extends away from the tractor unit front 14 and is attached to the extendable mast section 24. The extendable mast section 24 raises and lowers the load handler 26 and the mast 18 is transversely movable relative to the tractor unit 12 to move the load handler 26 transversely across the front 14 of the tractor unit 12.

In one embodiment of the lift truck, the load handler 26 includes a fork support extending forwardly away from the front 14 of the tractor unit 12. The fork support supports a pair of first forks 32 and a pair of second forks 36. The first forks 32 extend transversely relative to the front 14 of the tractor unit 12 in one direction and the second forks 36 extend transversely relative to the front 14 of the tractor unit 12 in an opposing direction. Preferably, the fork support is a load backrest 30 defining a vertical plane 28 extending through the mast fixed base 16. Although a fork support in the form of a load backrest is preferred, the fork support can be any structure supporting oppositely extending forks, such as a structural beam, without departing from the scope of the invention.

The first forks 32 are pivotally fixed to the load backrest 30 and movable between a working position and a stored position. In the working position, the forks 32 extend away from one side 34 the load backrest 30 and are substantially perpendicular to the vertical plane 28. Advantageously, in the working position, the forks 32 are substantially parallel to the ground for engagement with a load, as shown in FIG. 2. In the stored position, the forks 32 are substantially parallel to the vertical plane 28, as shown in FIG. 3, to minimize the width if the load handler and allowing operation of the material handling vehicle 10 in a narrow aisle.

The second forks 36 are pivotally fixed to the load backrest 30 and also movable between a working position and a stored position. In the working position, the second forks 36 extend away from another side 38 of the load backrest 30 facing away from the one side 34 of the backrest 30. In the working position, the second forks 36 extend substantially perpendicular to the vertical plane 28, as shown in FIG. 3. In the stored position, the second forks 36 are substantially parallel to the vertical plane 28, as shown in FIG. 2, to minimize the width if the load handler and allowing operation of the material handling vehicle 10 in a narrow aisle.

Figure 4:
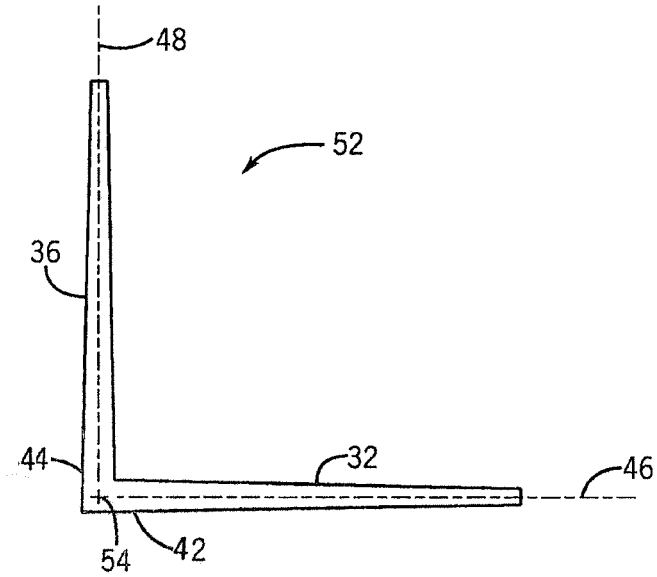
FIG. 4 is a front view of the L-shaped article of FIG. 1

Preferably, each first fork 32 is coupled to one of the second forks 36, such that when the first fork is in the working position, the second fork 36 coupled to the first fork 32 is in the stored position. In one embodiment, this is accomplished by joining a base 42, or proximal end, of the first fork 32 having a longitudinal axis 46 to a base 44, or proximal end, of the second fork 36 having a longitudinal axis 48 to form an L-shaped article 52, such as shown in FIG. 4. A pivot axis 54 extends through L-shaped article at the intersection of the longitudinal axes 46, 48 of the first and second forks 32, 36.

As shown in FIGS. 1-3, the L-shaped article is mounted to the load backrest 30 with the pivot axis proximal a lower edge 56 of the lower back rest 30 in the lower backrest vertical plane 28. The L-shaped article 52 is pivotal relative to the load backrest 30 about the pivot axis 54, such that pivotal movement of the L-shaped article 52 simultaneously moves one of the forks 32, 36 from the stored position to the working position and the other of the forks 32, 36 from the working position to the stored position.

Hard stops 62 formed in the load backrest 30 engage the first forks 32 in the stored position when the second forks 36 reach the working position. Likewise, the hard stops 62 engage the second forks 36 in the stored position when the first forks 32 reach the working position. Advantageously, the hard stops 62 ensure the forks 32, 36 in the working position are properly positioned for engaging a load.

Preferably, the L-shaped article is fixed to a rotatable shaft 64 coaxial with the pivot axis 54. A motor 66, such as an electric motor, rotatably drives the shaft 64 to pivot the L-shaped article 52 about the pivot axis 54 and move the forks 32, 36 between the working position and stored position. The motor 66 can be directly coupled to the L-shaped article 52 or connected via a belt or chain without departing from the cope of the invention. Moreover, the L-shaped article 52 can be moved between the working position and stored position using other methods, such as manually, hydraulics, and the like without departing from the scope of the invention.

In use, a material handling vehicle 10 incorporating the present invention accesses a pallet, or other load, stored in a rack system having a narrow aisle by driving the material handling vehicle down the narrow aisle to a position adjacent the storage location, for example a position to the left of a driver of the vehicle, of the pallet in the track system. The driver of the vehicle 10 moves the first forks 32 to the working position, extends the extendible mast section 24 of the mast 18 to raise the load handler 26 and align the first forks 32 for engagement with the pallet. Preferably, as the first forks 32 move to the working position, the second forks 36 simultaneously move to the storage position. Transverse movement of the mast 18 toward the storage location engages the first forks 32 with the pallet and vertical movement of the extendible mast section 24 raises the pallet above supports of the storage location. Transverse movement of the mast 18 away from the storage location retrieves the pallet into the aisle. The driver of the vehicle 10 then can continue to an end of the aisle to disengage the pallet from the first forks 32 and deposit the pallet outside of the rack system.

Upon disengaging the pallet from the first forks 32, the driver can retrieve a pallet, or other load, from a storage location in the rack system to the right of the vehicle driver by moving the first forks 32 to the storage position and the second forks to the working position and position the load handler 26 to align the second forks 36 for engagement with a pallet disposed in the storage location to the right of the vehicle driver. As in retrieval of the pallet from the storage location to the vehicle driver's left, transverse movement of the mast 18 toward the storage location to the right engages the forks 36 with the pallet and vertical movement of the extendible mast section 24 raises the pallet above supports of the storage location. Transverse movement of the mast 18 away from the storage location retrieves the pallet into the aisle. The driver of the vehicle 10 can then continue to an end of the aisle to disengage the pallet from the second forks 36 and deposit the pallet outside of the rack system.

Figure 5:
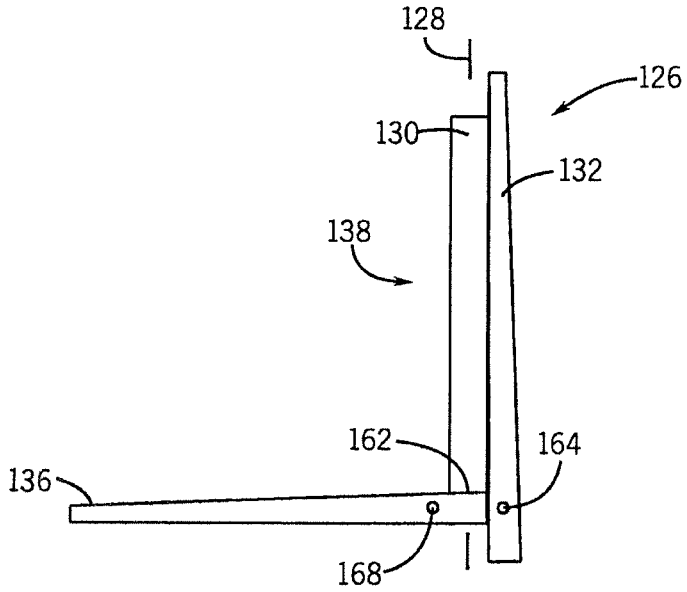
FIG. 5 is a front view of an alternate embodiment of the load handler of FIG. 1.
Figure 6:
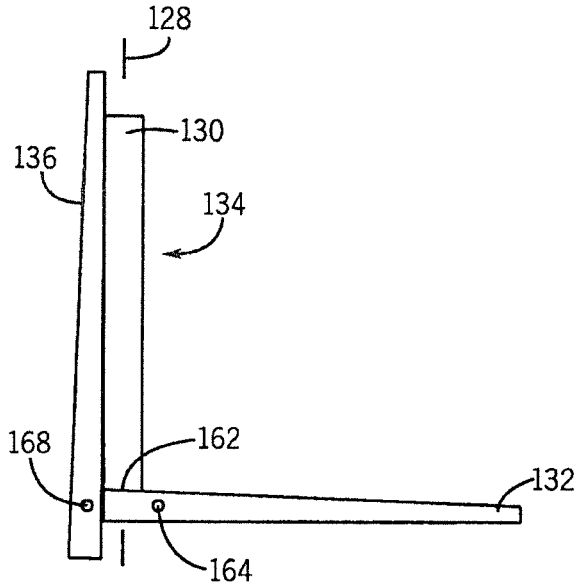
FIG. 6 is a front view of the load handler of FIG. 5 with the forks in different positions.

In another embodiment shown in FIGS. 5 and 6, a load handler 126 includes a backrest 130 attached to the extendible mast section 24, such as described above. As in the embodiment described above, first forks 132 pivotally fixed to the load backrest 130 are movable between a working position and a stored position. In the working position, the forks 132 extend away from one side 134 the load backrest 130 and are substantially perpendicular to the vertical plane 128. Advantageously, in the working position, the forks 32 are substantially parallel to the ground for engagement with a load, as shown in FIG. 5. In the stored position, the forks 132 are substantially parallel to the vertical plane 128, as shown in FIG. 6. The first forks 132 are joined by a first shaft 164 rotatably driven by a first motor to pivotally move the first forks 132 between the working position and the stored position.

Second forks 136 pivotally fixed to the load backrest 30 are also movable between a working position and a stored position. In the working position, the second forks 136 extend away from another side 138 of the load backrest 130 facing away from the one side 134 of the backrest 130. In the working position, the second forks 136 extend substantially perpendicular to the vertical plane 128, as shown in FIG. 6. In the stored position, the second forks 136 are substantially parallel to the vertical plane 128, as shown in FIG. 5. The second forks 136 are joined by a second shaft 168 rotatably driven by a second motor to pivotally move the second forks 136 between the working position and the stored position.

Preferably, a controller controlling the first and second motors simultaneously operates the first and second motors, such that as the first forks 132 move to the working position, the second forks 136 simultaneously move to the storage position, and vice versa. Advantageously, moving the first and second forks 132, 136 simultaneously between the working and stored positions minimizes the time required to retrieve loads from opposite sides of an aisle. A hard stop 162 on a bottom of the load backrest 130 stops pivotal movement of the forks 132, 136 in the working position.

Figure 7:
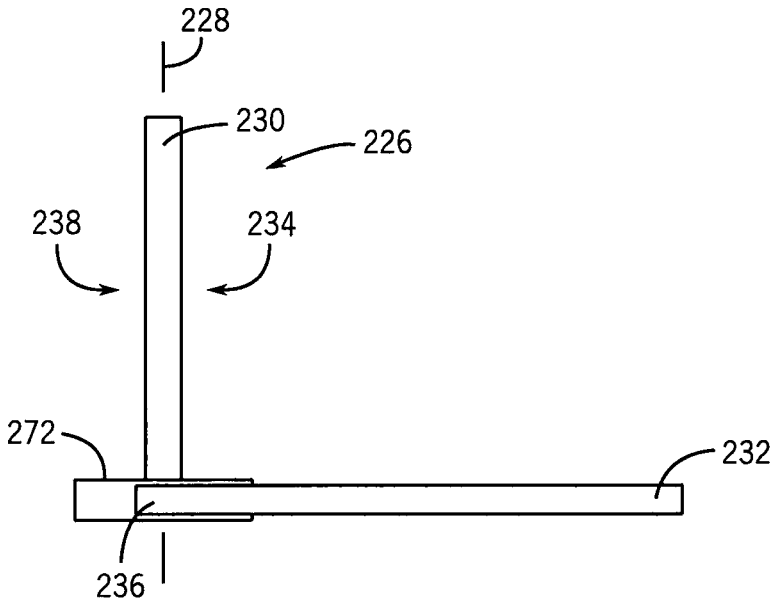
FIG. 7 is a front view of an alternate embodiment of the load handler of FIG. 1.
Figure 8:
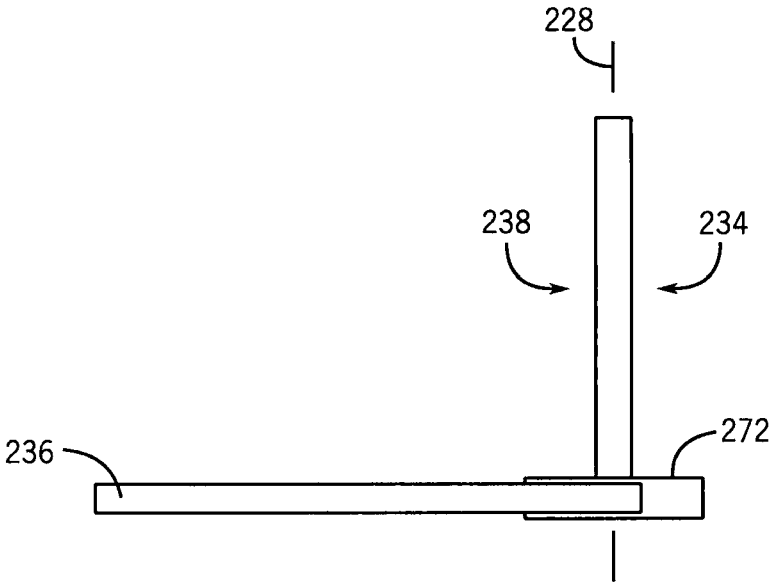
FIG. 8 is a front view of the load handler of FIG. 7 with the forks in different positions.

In another embodiment shown in FIGS. 7-10, a load handler 226 includes a backrest 230 attached to the extendible mast section 24, such as described above. In the embodiment shown in FIGS. 7 and 8, first forks 132 are slidably fixed to the load backrest 230 and are movable between a working position and a stored position. In the working position, the first forks 232 extend away from one side 234 of the load backrest 230 and are substantially perpendicular to the vertical plane 228. Advantageously, in the working position, the forks 232 are substantially parallel to the ground for engagement with a load, as shown in FIG. 7. In the stored position, the first forks 232 remain substantially perpendicular to the vertical plane 228, as shown in FIG. 8.

Second forks 236 slidably fixed to the load backrest 230 are also movable between a working position and a stored position. In the working position, the second forks 236 extend away from another side 238 of the load backrest 230 facing away from the one side 234 of the backrest 230. In the working position, the second forks 236 extend substantially perpendicular to the vertical plane 228, as shown in FIG. 8. In the stored position, the second forks 236 are substantially perpendicular to the vertical plane 228, as shown in FIG. 7.

Figure 9:
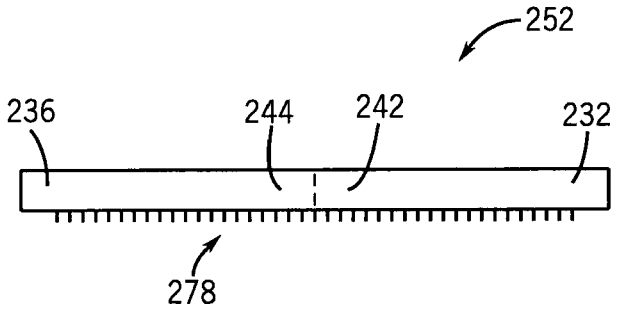
FIG. 9 is a top view of the straight article of FIG. 7.

Preferably, each first fork 232 is coupled to one of the second forks 236, such that when the first fork 232 is in the working position, the second fork 236 coupled to the first fork 232 is in the stored position. In one embodiment, this is accomplished by joining a base 242, or proximal end, of the first fork 232 to a base 244, or proximal end, of the second fork 236 to form a straight article 252, such as shown in FIG. 9.

The straight article is mounted to the load backrest 230 in a sleeve 272 through which the straight article 252 slidably moves. The straight article 252 is horizontally movable relative to the load backrest 230 through the sleeve 272, such that sliding movement of the straight article 252 simultaneously moves one of the forks 232, 236 from the stored position to the working position and the other of the forks 232, 236 from the working position to the stored position. Of course, bearings or wear surfaces can be provided in the sleeve to reduce friction when moving the straight article 252 through the sleeve 272.

Figure 10:
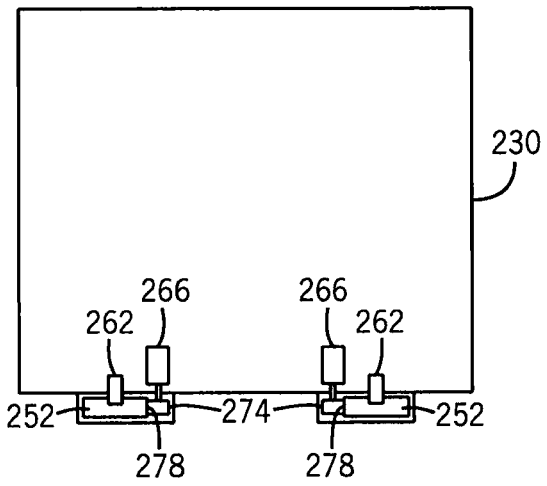
FIG. 10 is a side view of the load handler of FIG. 7.

As shown in FIG. 10, hard stops 262 in the form of a pin or plate selectively extending from the load backrest 230 is received in a opening or groove formed in the straight article 252 to lock the forks 232, 236 in the working or stored positions. Preferably, each straight article 252 includes a rack 278 engageable by a pinion 274 rotatably driven by a motor 266, such as an electric motor, to drive the forks 232, 236 between the working position and stored position.

A preferred embodiment of the invention has been described in considerable detail. Many modifications and variations to the preferred embodiment described will be apparent to a person of ordinary skill in the art. Therefore, the invention should not be limited to the embodiment described.

I claim:

1. A material handling vehicle comprising:

a vehicle body;

a vertically extendible mast fixed to said vehicle body;

a fork support fixed relative to said mast, said fork support having a first side and a second side, said first side facing away from said second side;

a downwardly facing stop on a bottom of said fork support interposed between said first side and said second side;

a first fork pivotably mounted about a first pivot axis adjacent said first side of said fork support and pivotable between a first fork stored position and a first fork working position, in said first fork stored position, said first fork extends substantially vertically, and in said first fork working position, said first fork extends substantially horizontally away from said first side of said fork support and engages said stop; and a second fork pivotably mounted about a second pivot axis adjacent said second side of said fork support and pivotable between a second fork stored position and a second fork working position, in said second fork stored position, said second fork extends substantially vertically when said first fork is in first fork working position, and in said second fork working position, said second fork extends substantially horizontally away from said second side of said fork support and engages said stop when said first fork is in said first fork stored position.

2. The material handling vehicle as in claim 1, including a motor driving said first fork between said first fork working position and said first fork stored position.

3. The material handling vehicle as in claim 1, including a shaft coupled to at least one of said first fork and said second fork, wherein rotation of said shaft pivots said at least one of said first fork and said second fork about at least one of said first pivot axis and said second pivot axis.

4. The material handling vehicle as in claim 1, in which said fork support includes at least one fork stop, wherein at least one of said first fork and said second fork is engageable with said at least one fork stop preventing pivotal movement of said at least one of said first fork and said second fork past said at least one fork stop.

5. The material handling vehicle as in claim 1, in which said first fork moves from said first fork working position to said first fork stored position simultaneously with said second fork moving from said second fork stored position to said second fork working position.

6. The material handling vehicle as in claim 1, in which said fork support is a load backrest.

7. The material handling vehicle as in claim 1, in which said first pivot axis is parallel to said second pivot axis.

8. The material handling vehicle as in claim 1, in which said first pivot axis is not coaxial with said second pivot axis.

9. The material handling vehicle as in claim 1, in which said first fork is engageable with said stop only when said second fork is in said second fork stored position, and said second fork is engageable said stop only when said first fork is in said first fork stored position.

10. A load handler attachable to a material handling vehicle, said load handler comprising:

a fork support having a first side and a second side, said first side facing away from said second side;

a downwardly facing stop on a bottom of said fork support interposed between said first side and said second side;

a first fork pivotably mounted about a first pivot axis adjacent said first side of said fork support and pivotable between a first fork stored position and a first fork working position, in said first fork stored position, said first fork extends substantially vertically, and in said first fork working position, said first fork extends substantially horizontally away from said first side of said fork support and engages said stop; and a second fork pivotably mounted about a second pivot axis adjacent said second side of said fork support and pivotable between a second fork stored position and a second fork working position, in said second fork stored position, said second fork extends substantially vertically when said first fork is in first fork working position, and in said second fork working position, said second fork extends substantially horizontally away from said second side of said fork support and engages said stop when said first fork is in said first fork stored position, wherein said first pivot axis is not coaxial with said second pivot axis.

11. The load handler as in claim 10, including a motor driving said first fork between said first fork working position and said first fork stored position.

12. The load handler as in claim 10, including a shaft coupled to at least one of said first fork and said second fork, wherein rotation of said shaft pivots said at least one of said first fork and said second fork about at least one of said first pivot axis and said second pivot axis.

13. The load handler as in claim 10, in which said fork support includes at least one fork stop, wherein at least one of said first fork and said second fork is engageable with said at least one fork stop preventing pivotal movement of said at least one of said first fork and said second fork past said at least one fork stop.

14. The load handler as in claim 10, in which said first fork moves from said first fork working position to said first fork stored position simultaneously with said second fork moving from said second fork stored position to said second fork working position.

15. The load handler as in claim 10, in which said fork support is a load backrest.

16. The load handler as in claim 10, in which said first pivot axis is parallel to said second pivot axis.

17. The load handler as in claim 10, in which said first fork is engageable with said stop only when said second fork is in said second fork stored position, and said second fork is engageable said stop only when said first fork is in said first fork stored position.

18. A load handler attachable to a material handling vehicle, said load handler comprising:

a fork support having a first side and a second side, said first side facing away from said second side;

a downwardly facing stop on a bottom of said fork support interposed between said first side and said second side a first fork pivotably mounted about a first pivot axis adjacent said first side of said fork support and pivotable between a first fork stored position and a first fork working position, in said first fork working position, said first fork extends away from said first side of said fork support and engages said stop; and a second fork pivotably mounted about a second pivot axis adjacent said second side of said fork support and pivotable between a second fork stored position and a second fork working position, in said second fork working position, said second fork extends away from said second side of said fork support and engages said stop, wherein said first side of said fork support faces away from said second side of said fork support, such that when said first fork is in said first fork working position, said first fork extends away from said first side of said fork support substantially horizontally in a direction opposite to said second fork when said second fork is in said second fork working position extending away from said second side of said fork support, and said first pivot axis is not coaxial with said second pivot axis.

19. The load handler as in claim 18, in which said first fork is engageable with said stop only when said second fork is in said second fork stored position, and said second fork is engageable said stop only when said first fork is in said first fork stored position.

* * * * *